US009597558B1

(12) United States Patent
Seluga et al.

(10) Patent No.: US 9,597,558 B1
(45) **Date of Patent: *Mar. 21, 2017**

(54) GOLF CLUB HEAD HAVING COMPOSITE TUBES

(71) Applicant: Callaway Golf Company, Carlsbad, CA (US)

(72) Inventors: James A. Seluga, Carlsbad, CA (US); Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/788,326

(22) Filed: Jun. 30, 2015

(51) Int. Cl.
*A63B 53/06* (2015.01)
*A63B 53/04* (2015.01)

(52) U.S. Cl.
CPC .... *A63B 53/0466* (2013.01); *A63B 2053/045* (2013.01); *A63B 2053/0408* (2013.01); *A63B 2053/0412* (2013.01)

(58) Field of Classification Search
CPC .. A63B 53/04; A63B 53/06; A63B 2053/0791
USPC ..... 473/324, 329, 330, 334, 340, 342
See application file for complete search history.

(56) References Cited

U.S. PATENT DOCUMENTS 1,133,129 A * 3/1915 Govan ..... A63B 53/047 473/337
3,652,094 A * 3/1972 Glover ..... A63B 53/08 473/337
4,461,479 A * 7/1984 Mitchell ..... A63B 60/24 473/292
4,795,159 A * 1/1989 Nagamoto ..... A63B 53/04 473/338
4,883,274 A * 11/1989 Hsien ..... A63B 53/04 473/335
5,082,278 A * 1/1992 Hsien ..... A63B 53/04 473/242
5,152,527 A * 10/1992 Mather ..... A63B 60/24 473/291
5,273,283 A * 12/1993 Bowland ..... A63B 53/04 473/338
5,299,807 A * 4/1994 Hutin ..... A63B 53/04 473/329
5,582,553 A * 12/1996 Ashcraft ..... A63B 53/04 473/338
5,586,947 A * 12/1996 Hutin ..... A63B 53/04 473/324
5,692,967 A * 12/1997 Guyer ..... A63B 69/3661 473/262
5,766,094 A 6/1998 Mahaffey et al.
6,033,318 A * 3/2000 Drajan, Jr. ..... A63B 53/02 473/309
6,368,231 B1 * 4/2002 Chen ..... A63B 53/04 473/329

(Continued)

FOREIGN PATENT DOCUMENTS

JP 3821516 9/2006

*Primary Examiner* — William Pierce
(74) *Attorney, Agent, or Firm* — Michael Catania; Rebecca Hanovice; Sonia Lari

(57) ABSTRACT

A golf club head comprising a body and a plurality of carbon tubes is disclosed herein. The body comprises a face section, a sole section and a crown section. The body defines a hollow interior. Each of the plurality of carbon tubes extends from the crown section to the sole section.

7 Claims, 7 Drawing Sheets

(56) References Cited

U.S. PATENT DOCUMENTS 6,383,090 B1 5/2002 O'Doherty et al.
6,413,168 B1 * 7/2002 McKendry ..... A63C 11/221 280/823
6,506,128 B1 * 1/2003 Bloom, Jr. ..... A63B 53/007 473/292
6,852,038 B2 2/2005 Yabu
6,979,270 B1 12/2005 Allen
7,387,579 B2 6/2008 Lin et al.
7,744,484 B1 * 6/2010 Chao ..... A63B 53/0466 473/324
7,824,277 B2 * 11/2010 Bennett ..... A63B 53/0466 473/328
7,914,393 B2 * 3/2011 Hirsch ..... A63B 53/0466 473/332
8,197,357 B1 * 6/2012 Rice ..... A63B 53/0466 473/334
8,403,771 B1 * 3/2013 Rice ..... A63B 53/04 473/328
8,419,564 B1 * 4/2013 Solheim ..... A63B 53/08 403/290
8,540,587 B2 * 9/2013 Hirsch ..... A63B 53/0466 473/332
8,591,352 B2 * 11/2013 Hirano ..... A63B 53/0466 473/336
8,663,027 B2 3/2014 Morales et al.
8,834,294 B1 * 9/2014 Seluga ..... A63B 53/04 473/338
8,911,301 B1 * 12/2014 Allen ..... A63B 53/047 473/329
8,956,244 B1 * 2/2015 Westrum ..... A63B 53/06 473/338
8,986,133 B2 * 3/2015 Bennett ..... A63B 59/0092 473/329
9,067,110 B1 * 6/2015 Seluga ..... A63B 53/06
9,180,349 B1 * 11/2015 Seluga ..... A63B 53/04
9,216,332 B1 * 12/2015 Ehlers ..... A63B 53/06
2002/0137576 A1 * 9/2002 Dammen ..... A63B 53/04 473/336
2012/0071258 A1 * 3/2012 Yamaguchi ..... A63B 53/00 473/287
2013/0165252 A1 * 6/2013 Rice ..... A63B 53/04 473/329
2013/0165254 A1 * 6/2013 Rice ..... A63B 53/0466 473/329
2013/0184099 A1 * 7/2013 Stites ..... A63B 53/06 473/338
2013/0244808 A1 * 9/2013 Bennett ..... A63B 53/06 473/335
2015/0094166 A1 * 4/2015 Taylor ..... A63B 53/06 473/335
2015/0165280 A1 6/2015 Hebreo

* cited by examiner

GOLF CLUB HEAD HAVING COMPOSITE TUBES

The present invention is a continuation-in-part of U.S. patent application Ser. No. 14/755,068, filed on Jun. 30, 2015, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which claims priority to U.S. Provisional Patent Application No. 61/898,956, filed on Nov. 1, 2013, and which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application No. 61/665,203, filed on Jun. 27, 2012, and 61/684,079, filed on Aug. 16, 2012.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with composite tubes.

Description of the Related Art

The prior art discloses various golf club heads having interior structures.

Yabu, U.S. Pat. No. 6,852,038 for a Golf Club Head And Method OF Making The Same, discloses a golf club head with a sound bar.

Galloway, U.S. Pat. No. 7,118,493 for a Multiple Material Golf Club Head discloses a golf club head with a composite aft body having an interior sound component extending upward from a sole section of a metal face component.

Seluga et al., U.S. Pat. No. 8,834,294 for a Golf Club Head With Center Of Gravity Adjustability discloses a golf club head with a tube having a mass for adjusting the CG of a golf club head.

Dawson et al., U.S. Pat. No. 8,900,070 for a Weighted Golf Club Head discloses a golf club head with an interior weight lip extending from the sole towards the face.

However, the prior art fails to disclose an interior structure that increases ball speed through reducing stress in the face at impact, with a minimal increase in mass to the golf club head.

BRIEF SUMMARY OF THE INVENTION

The golf club head comprises interior carbon tubes to reduce the stress in a face during impact with a golf ball.

One aspect of the present invention is a golf club head comprising a body and a plurality of carbon tubes. The body comprises a face section, a sole section and a crown section. The body defines a hollow interior. Each of the plurality of carbon tubes extends from the crown section to the sole section.

Another aspect of the present invention is a golf club head comprising a body, a crown section and a plurality of carbon tubes. The body comprises a face section, a sole section and a return section. The crown section is disposed on the body to define a hollow interior of the golf club head. The carbon tubes are positioned within the hollow interior of the golf club head. Each of the plurality of carbon tubes extends from the return section to the sole section.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figures 1, 2:
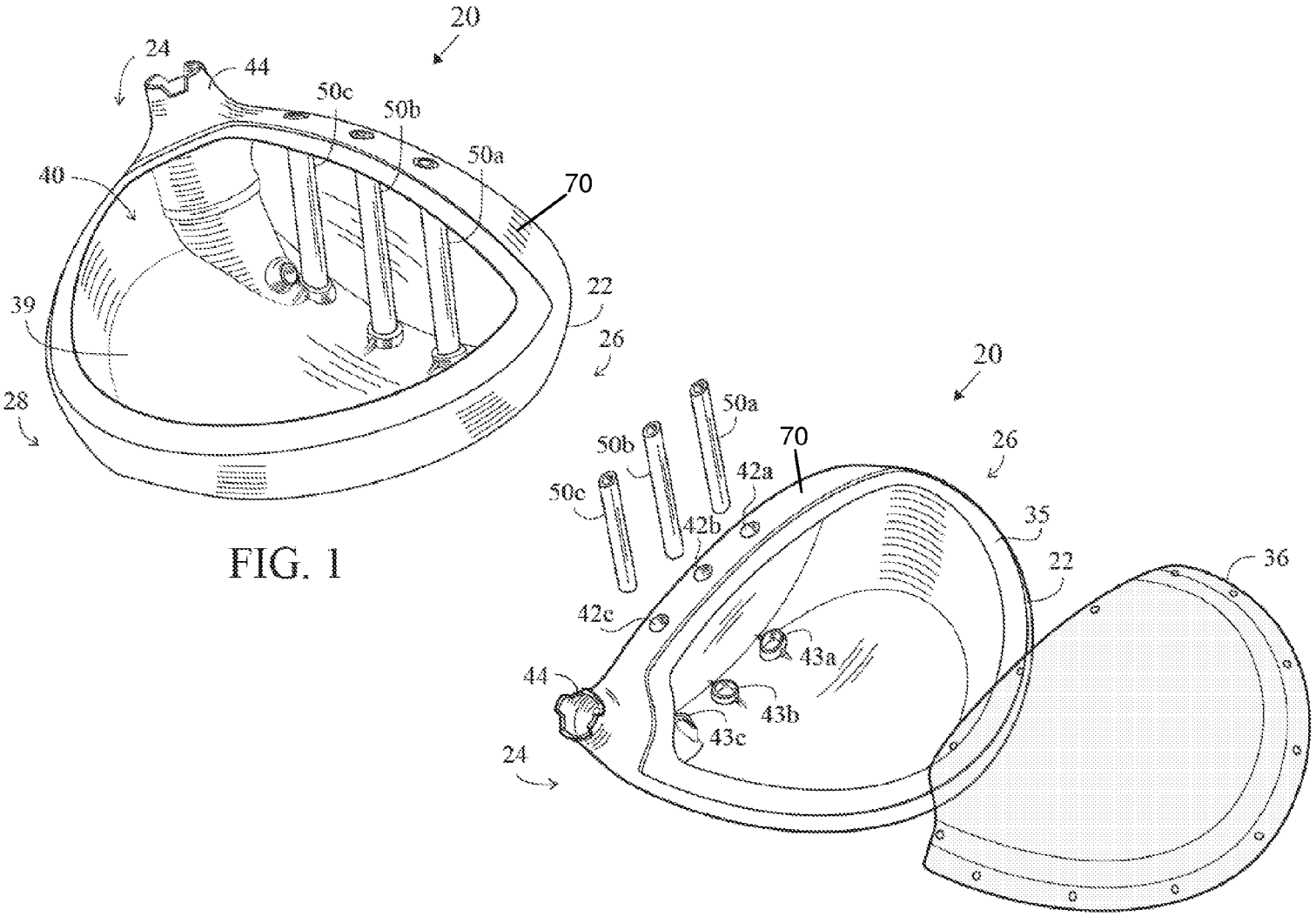
FIG. 1 is a top perspective view of a golf club head with a crown section removed to illustrate an interior.
FIG. 2 is a top perspective exploded view of a golf club head with composite tubes.
Figure 3:
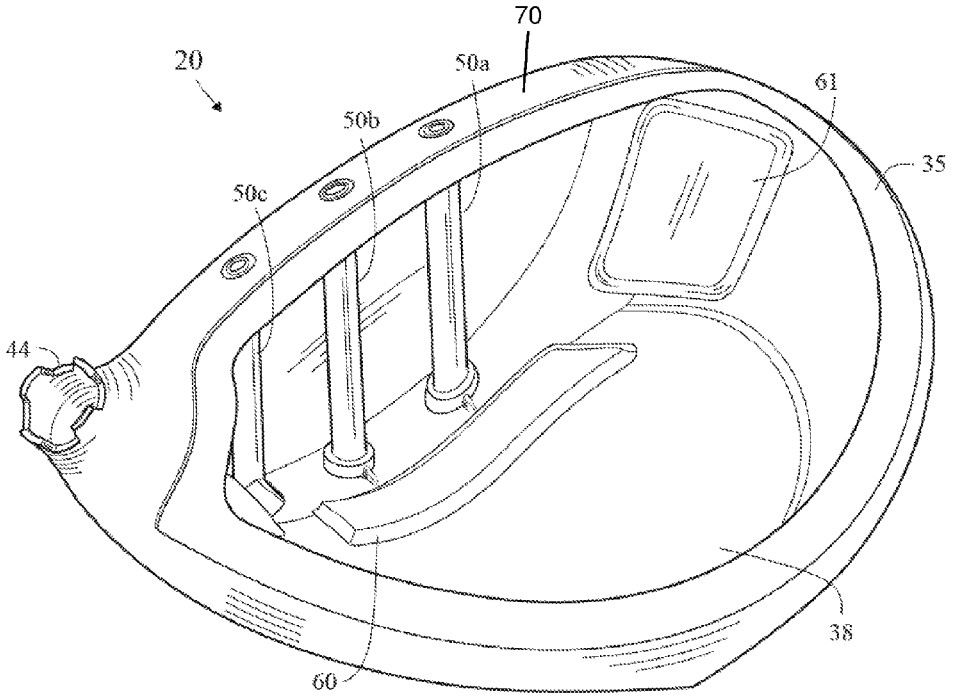
FIG. 3 is a top perspective view of a golf club head with a crown section removed to illustrate an interior.
Figure 4:
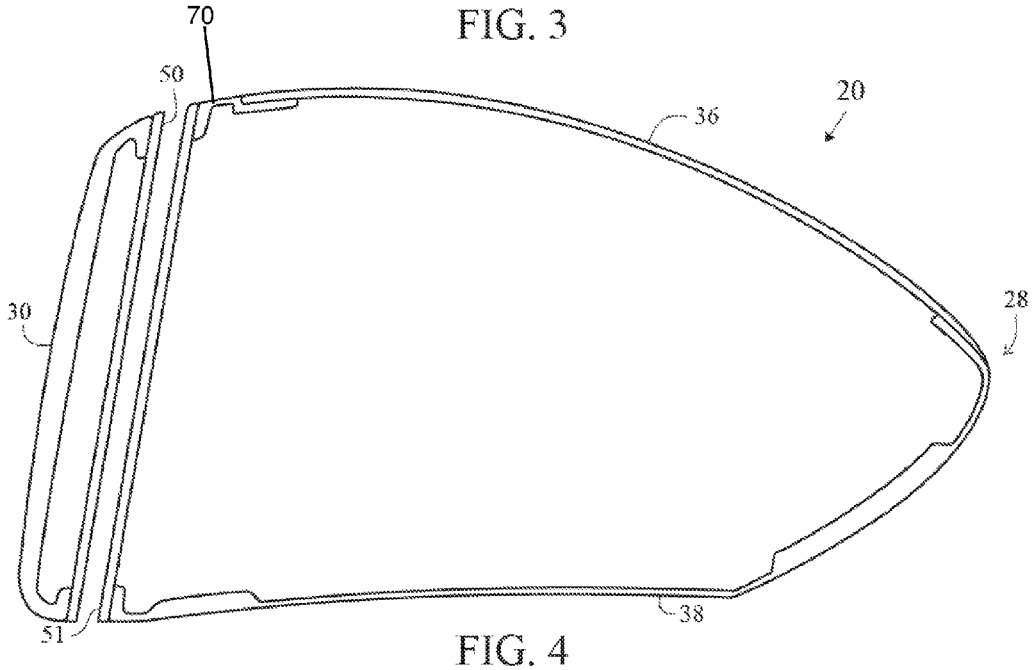
FIG. 4 is a cross-sectional view of a golf club head with composite tubes.
Figure 5:
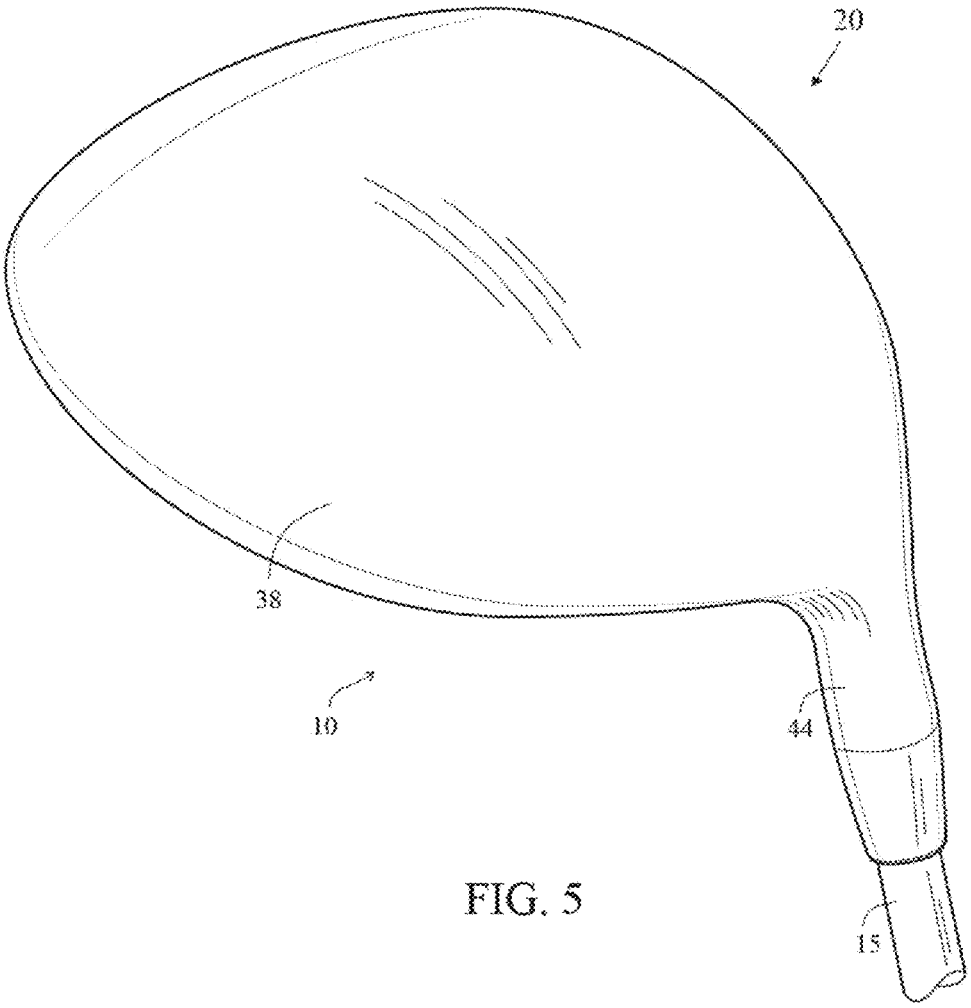
FIG. 5 is a bottom perspective view of a golf club head.
Figure 6:
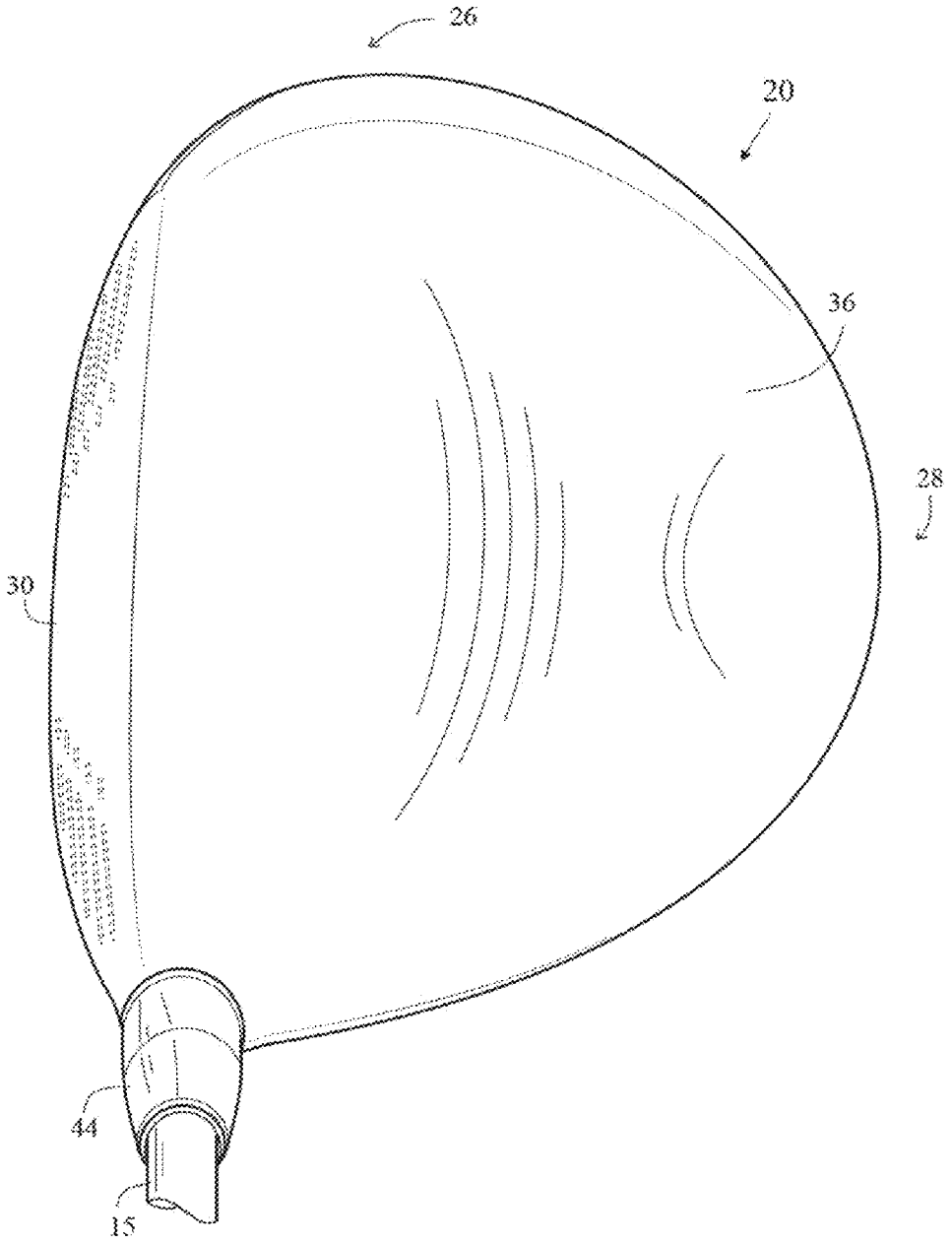
FIG. 6 is a top plan view of a golf club head.
Figure 7:
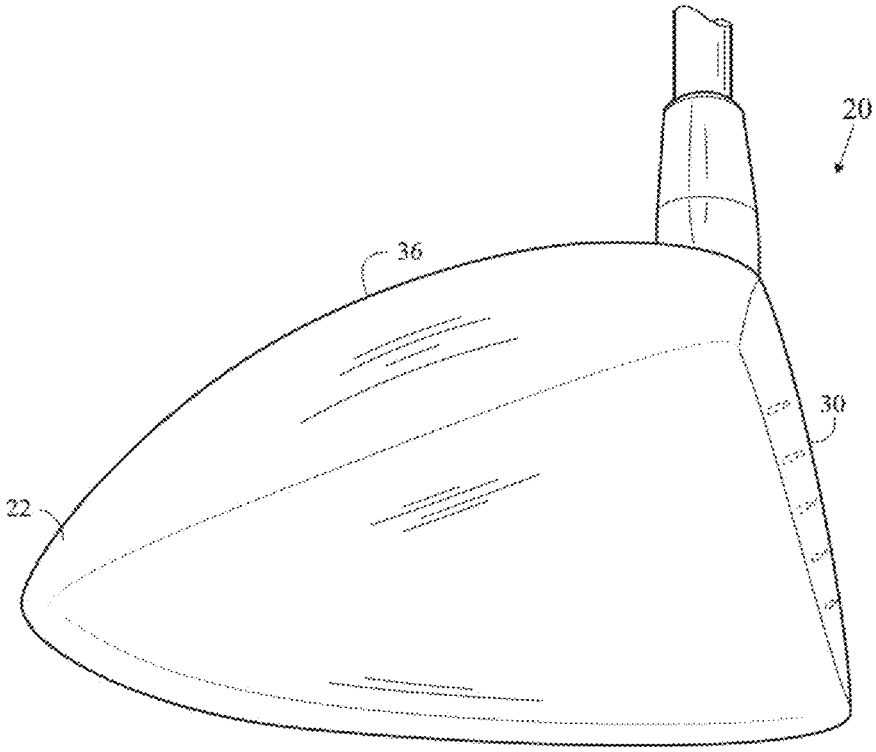
FIG. 7 is a side elevation view of a golf club head.
Figure 8:
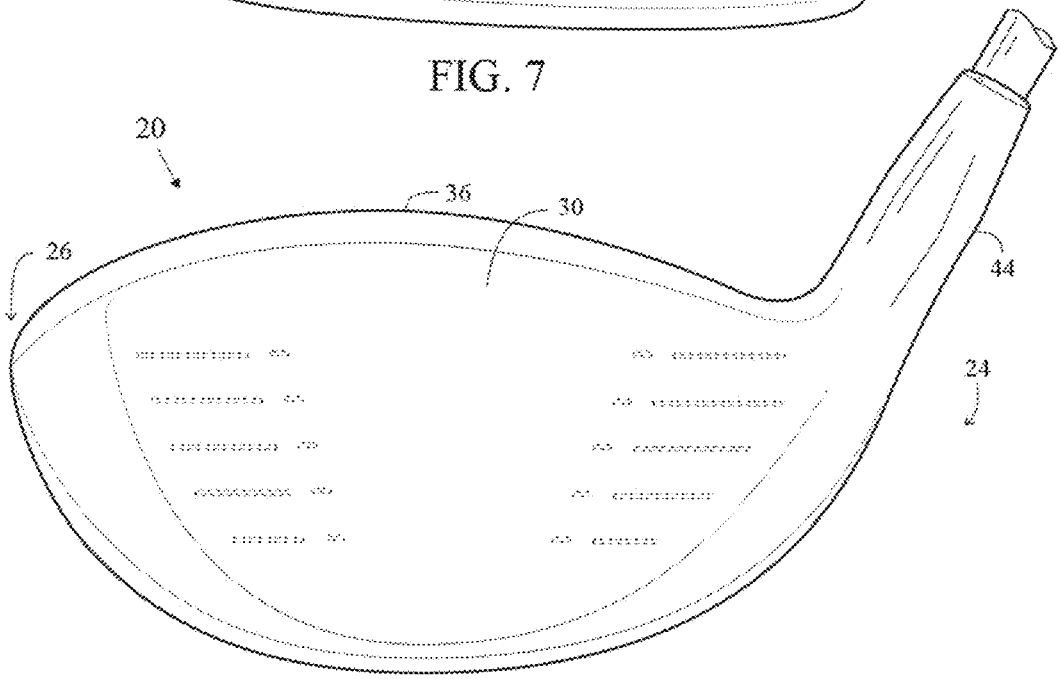
FIG. 8 is a front elevation view of a golf club head.
Figure 9:
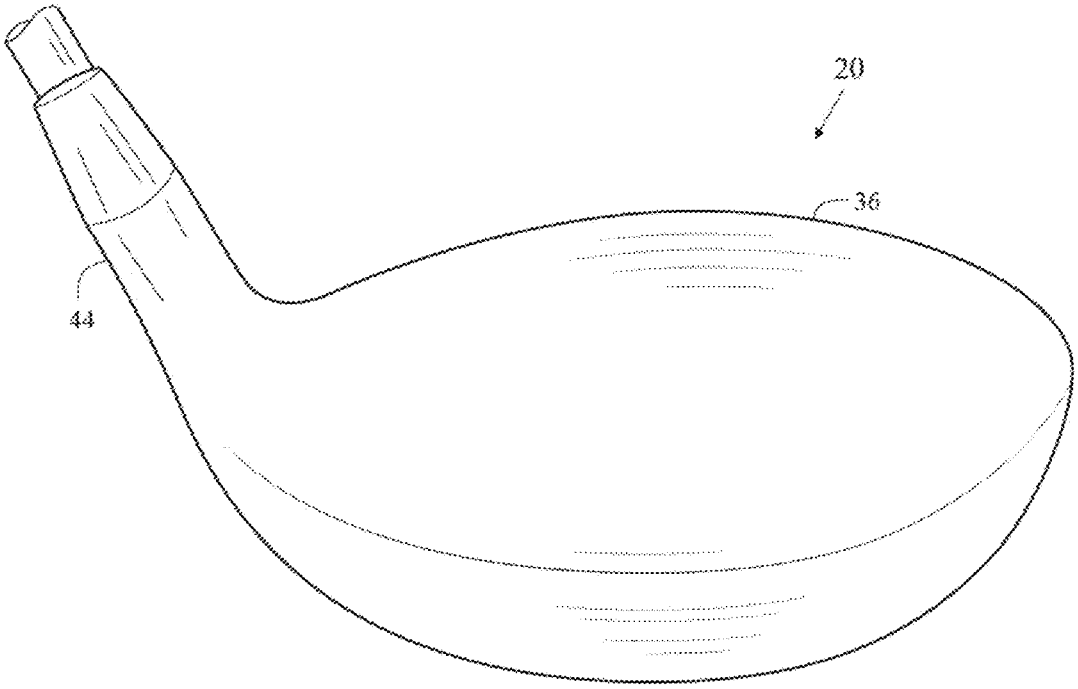
FIG. 9 is a rear elevation view of a golf club head.
Figure 10:
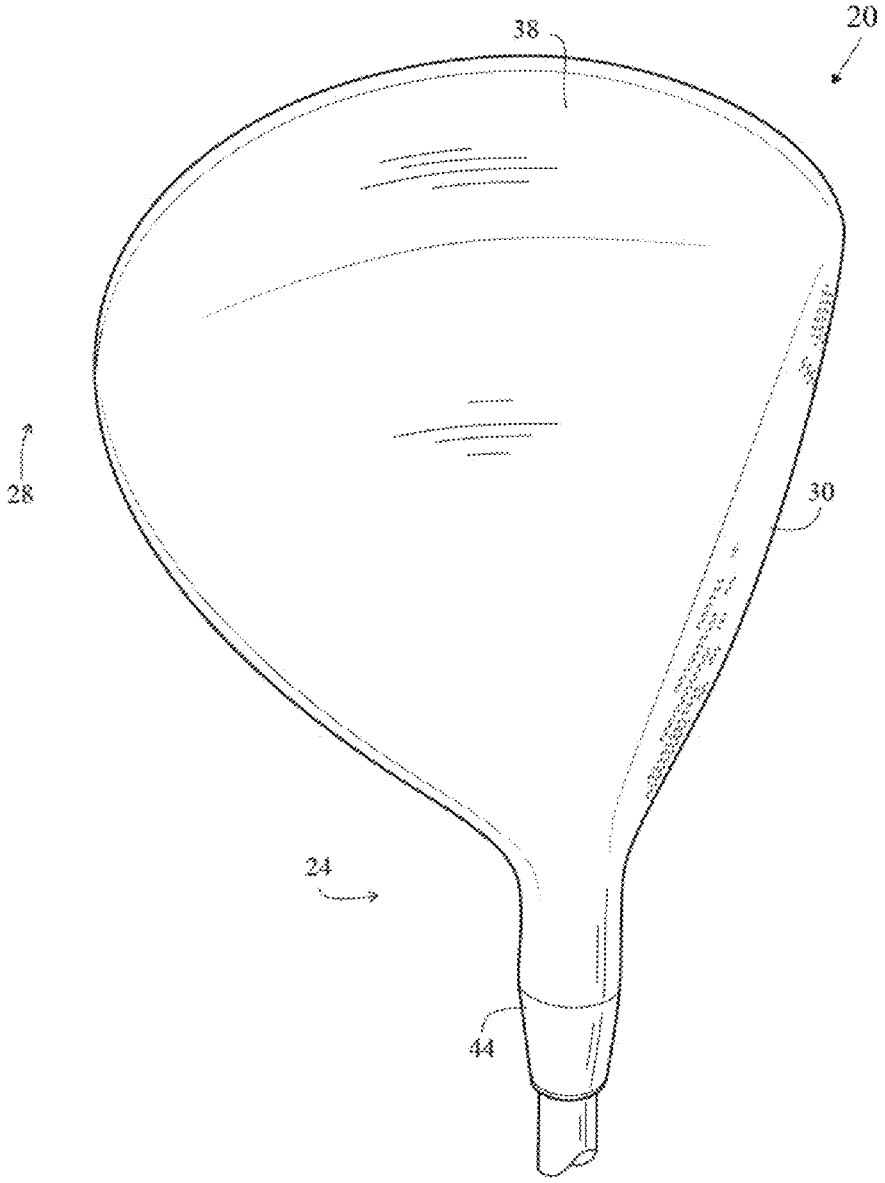
FIG. 10 is a bottom perspective view of a golf club head.

As shown in FIGS. 1-4, a golf club head is generally designated 20. The golf club head 20 preferably includes a body 22 having a sole section 38, a face section 30, a return section 70, a heel end 24, a toe end 26 and an aft end 28. A crown section 36 is placed on an opening 39 in the body 22, the opening defined by the sole section 38 and return section 70. The body section 22, along with the crown section 36, preferably defines a hollow interior 40. Within the hollow interior, multiple carbon tubes 50 extend from the sole section 38 upward to the return section 70.

The plurality of carbon tubes 50 preferably ranges from two carbon tubes to eight carbon tubes. Each of the plurality of carbon tubes 50 preferably has a diameter ranging from 2 millimeters to 5 millimeters. Each of the plurality of carbon tubes 50 preferably has a length ranging from 30 millimeters to 60 millimeters. Each of the plurality of carbon tubes 50 is preferably positioned within 11 millimeters of an interior surface of the face section 30. The mass of each of the plurality of carbon tubes 50 preferably ranges from 0.5 gram to 3 grams, more preferably from 1 gram to 2 grams, and most preferably each carbon tube 50 has a mass of 1.5 grams.

The return section 70 preferably comprises a plurality of apertures 42. Each of the plurality of apertures 42 preferably corresponds to a carbon tube 50 of the plurality carbon tubes 50. The sole section 38 preferably comprises a plurality of bosses 43. Each of the plurality of bosses 43 preferably corresponds to a carbon tube 50 of the plurality carbon tubes 50. The carbon tubes 50 are preferably glued into the bosses 50.

The high weight pads 60 and 61 preferably have a mass ranging from 5 grams to 50 grams, more preferably from 10 grams to 30 grams, and most preferably from 15 grams to 25 grams. The high weight pads 60 and 61 are preferably composed of a material that has a density ranging from 5 grams per cubic centimeters to 20 grams per cubic centimeters, more preferably from 7 grams per cubic centimeters to 12 grams per cubic centimeters.

The high weight pads 60 and 61 are preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyurethane. A preferred high weight pad 60 is an injection molded thermoplastic polyurethane integrated with tungsten to have a density of 8.0 grams per cubic centimeters. In an alternative embodiment, the high weight pad 60 is composed of from 50 to 95 volume percent polyurethane and from 50 to 5 volume percent tungsten. Also, in an alternative embodiment, the high weight pad 60 is composed of from 10 to 25 weight percent polyurethane and from 90 to 75 weight percent tungsten. The placement of the high weight pads 60 allow for the moment of inertia of the golf club head to be optimized.

The face section 30 preferably has a varying thickness. In a preferred embodiment, the face section 30 has a varying thickness such as described in U.S. Pat. No. 7,448,960, for a Golf Club Head With Variable Face Thickness, which pertinent parts are hereby incorporated by reference. Other alternative embodiments of the thickness of the face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the face section has a uniform thickness.

The body 22 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 22 is composed of 17-4 steel alloy. Additional methods for manufacturing the body 22 include forming the body 22 from a flat sheet of metal, super-plastic forming the body from a flat sheet of metal, machining the body 22 from a solid block of metal, electrochemical milling the body 22 from a forged pre-form, casting the body using centrifugal casting, casting the body 22 using levitation casting, and like manufacturing methods.

The golf club head 20, when designed as a driver, preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. The volume of the golf club head 20 will also vary between fairway woods (preferably ranging from 3-woods to eleven woods) with smaller volumes than drivers.

The golf club head 20, when designed as a driver, preferably has a mass no more than 215 grams, and most preferably a mass of 180 to 215 grams. When the golf club head 20 is designed as a fairway wood, the golf club head preferably has a mass of 135 grams to 200 grams, and preferably from 140 grams to 165 grams.

A preferred embodiment of the golf club head 20 has a volume of 460 cubic centimeters with the Characteristic Time (CT) of the face close to, but not exceeding 257 microsecond ("0") limit set by the USGA.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A wood-type golf club head comprising:

a cast metal body comprising a face section, a sole section, and a return section, the sole section and return section defining an upper opening in the body;

a crown section disposed on the body to close the upper opening and define a hollow interior of the golf club head; and a plurality of carbon tubes positioned within the hollow interior of the golf club head, each of the plurality of carbon tubes extending from the return section to the sole section, wherein the plurality of carbon tubes ranges from two carbon tubes to eight carbon tubes, wherein each of the plurality of carbon tubes is positioned rearward from an interior surface of the face section a distance ranging from 2 millimeters to 11 millimeters, wherein the return section comprises a plurality of apertures, wherein each of the plurality of apertures corresponds to a carbon tube of the plurality carbon tubes, wherein the sole section comprises a plurality of bosses, and wherein each of the plurality of bosses corresponds to a carbon tube of the plurality carbon tubes.

2. The golf club head according to claim 1 wherein the crown section is composed of a composite material.

3. The golf club head according to claim 1 wherein each of the plurality of carbon tubes has a diameter ranging from 2 millimeters to 5 millimeters.

4. The golf club head according to claim 1 wherein each of the plurality of carbon tubes has a length ranging from 30 millimeters to 60 millimeters.

5. The golf club head according to claim 1 wherein the golf club head has a volume ranging from 200 cubic centimeters to 475 cubic centimeters.

6. The golf club head according to claim 1 wherein the body is composed of a titanium alloy.

7. The golf club head according to claim 1 wherein the body is composed of an iron alloy.

* * * * *